US007561386B2

(12) United States Patent
Masuda

(10) Patent No.: US 7,561,386 B2
(45) Date of Patent: Jul. 14, 2009

(54) SWITCH MONITORING CIRCUIT

(75) Inventor: Atsushi Masuda, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 263 days.

(21) Appl. No.: 11/255,924

(22) Filed: Oct. 24, 2005

(65) Prior Publication Data

US 2007/0091533 A1 Apr. 26, 2007

(51) Int. Cl.
*H01H 47/00* (2006.01)

(52) U.S. Cl. ..... 361/23; 361/155

(58) Field of Classification Search ..... 361/23, 361/92, 155, 156; 307/10.1, 10.2, 10.7
See application file for complete search history.

(56) References Cited

U.S. PATENT DOCUMENTS 5,153,558 A * 10/1992 Robinson et al. ..... 340/428
5,585,781 A * 12/1996 Sumida ..... 340/459
5,912,566 A * 6/1999 Tamura ..... 327/20
6,476,518 B1 * 11/2002 Hoshi et al. ..... 307/10.7
6,509,767 B2 * 1/2003 Tanaka et al. ..... 327/142
7,123,018 B2 * 10/2006 Nakazawa et al. ..... 324/415

FOREIGN PATENT DOCUMENTS

JP 08-65753 A 3/1996
JP 8-265859 A 10/1996
JP 10-228768 A 8/1998
JP 11-251887 A 9/1999
JP 2003-212066 A 7/2003

* cited by examiner

*Primary Examiner*—Danny Nguyen
(74) *Attorney, Agent, or Firm*—Sughrue Mion, PLLC

(57) ABSTRACT

A switch monitoring circuit includes a switch arranged to be turned ON/OFF in response to an operation, a capacitor connected to both ends of the switch, a voltage applying unit that applies a voltage to the switch in response to a command, a voltage detecting unit that detects the voltage applied to the switch and a diode connected to the switch and the capacitor. The diode prevents an electric charge stored in the capacitor from being emitted.

4 Claims, 1 Drawing Sheet

SWITCH MONITORING CIRCUIT

BACKGROUND OF THE INVENTION

The present invention relates to a switch monitoring circuit and more particularly to a switch monitoring circuit for supplying a power in response to a command in a state that an ignition is OFF in a vehicle such as a car.

In a vehicle such as a car, there are devices to which a power is to be supplied from a battery mounted on the vehicle also in a sleep state that an ignition is OFF. For example, in the case that a door is unlocked or locked in the sleep state or the case that a door mirror is folded or opened, it is necessary to supply a power from the battery to a motor.

Accordingly, the vehicle has a switch monitoring circuit for monitoring the state of a driving switch for a door lock or a door mirror. The switch monitoring circuit serves to detect the condition of the switch in the sleep state if necessary. Therefore, a microcomputer oscillates a strobe pulse based on a preset timing and a voltage applying unit is turned ON in response to the strobe pulse, thereby applying a power to the switch intermittently. Then, a change in the applied voltage is detected to monitor the opening and closing state of the switch.

Moreover, the switching monitoring circuit has a capacitor for taking a countermeasure against a static electricity to absorb the static electricity between the switch and the microcomputer in order to prevent the hand of an operator from touching the switch to generate the static electricity, and to hinder the microcomputer or the circuit from being damaged due to the static electricity when the operator turns ON/OFF the switch.

The capacitor for taking a countermeasure against the static electricity which is provided in the switch monitoring circuit carries out charging when a voltage is applied in a state that the switch to be monitored is opened, while it carries out discharging toward a ground point of the voltage applying unit or a microcomputer when the voltage is not applied. In the switch monitoring circuit in which the application of the voltage is ON/OFF controlled by the strobe pulse, accordingly, the charging and the discharging are repeated by the capacitor every cycle of the strobe pulse. Therefore, the consumed current of the capacitor is increased so that the dark current (idling current) of the vehicle is increased.

On the other hand, in recent years, a design corresponding to a formation into a module is carried out in order to shorten a time required for the design related to a vehicle, to easily change the design and to decrease a wire harness, resulting in a reduction in a cost. In this case, for example, a switch belonging to each driving portion such as a door mirror or a door lock is monitored by one microcomputer. More specifically, only one microcomputer monitors the switch as seen from a specific switch. Thus, the microcomputer for monitoring the switch is provided in each driving portion. As compared with the case that some microcomputers monitor switches provided in the whole vehicle through the wire harness in a related technique, therefore, the total number of microcomputers to be mounted on the vehicle is increased.

In a vehicle in which components are formed into a module, accordingly, the number of the microcomputers to be mounted is increased so that the number of capacitors for taking a countermeasure against a static electricity which are to be provided is also increased. As a result, a dark current to be generated on the vehicle in a sleep state is increased still more as compared with a vehicle in which components are not formed into a module. In some cases, therefore, a battery is dead so that the vehicle cannot be driven.

SUMMARY OF THE INVENTION

It is an object of the invention to reduce a dark current to be generated on the vehicle in a sleep state.

In order to achieve the above object, according to the present invention, there is provided a switch monitoring circuit, comprising:

a switch arranged to be turned ON/OFF in response to an operation;

a capacitor connected to both ends of the switch;

a voltage applying unit that applies a voltage to the switch in response to a command;

a voltage detecting unit that detects the voltage applied to the switch; and a diode connected to the switch and the capacitor, wherein the diode prevents an electric charge stored in the capacitor from being emitted. Thus, the problem is solved.

By such a structure, even if an electric charge generated by the voltage applied to the switch is stored in the capacitor and the application of the voltage is then stopped when the switch is opened, it is possible to prevent the emission of the electric charge stored in the capacitor toward the ground point of the voltage applying unit or the microcomputer by the rectifying function of the diode. Accordingly, it is possible to avoid the repetition of the charging and the discharging through the capacitor. Therefore, it is possible to reduce the consumed current of the capacitor. As a result, it is possible to reduce a dark current to be generated on a vehicle in a sleep state.

Preferably, the voltage applying unit is connected to the switch and the capacitor through the diode.

Preferably, the voltage applying unit for applying a voltage to the switch is constituted to have a switching portion for carrying out an ON/OFF control in response to a strobe pulse, a power supply portion for supplying a power corresponding to the ON/OFF control of the switching portion, and a pull-down resistor grounded to a terminal on the output side of the switching portion.

Consequently, the switching portion can supply a power from the power supply unit to the switch when a strobe pulse having a high level and a low level repeated in a predetermined cycle is on the high level, while it can stop the supply of the power when the pulse is on the low level. By variably setting the cycle of the strobe pulse, accordingly, it is possible to supply a power to the switch only when the state of the switch is to be detected.

According to the invention, it is possible to reduce the dark current to be generated on the vehicle in the sleep state.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
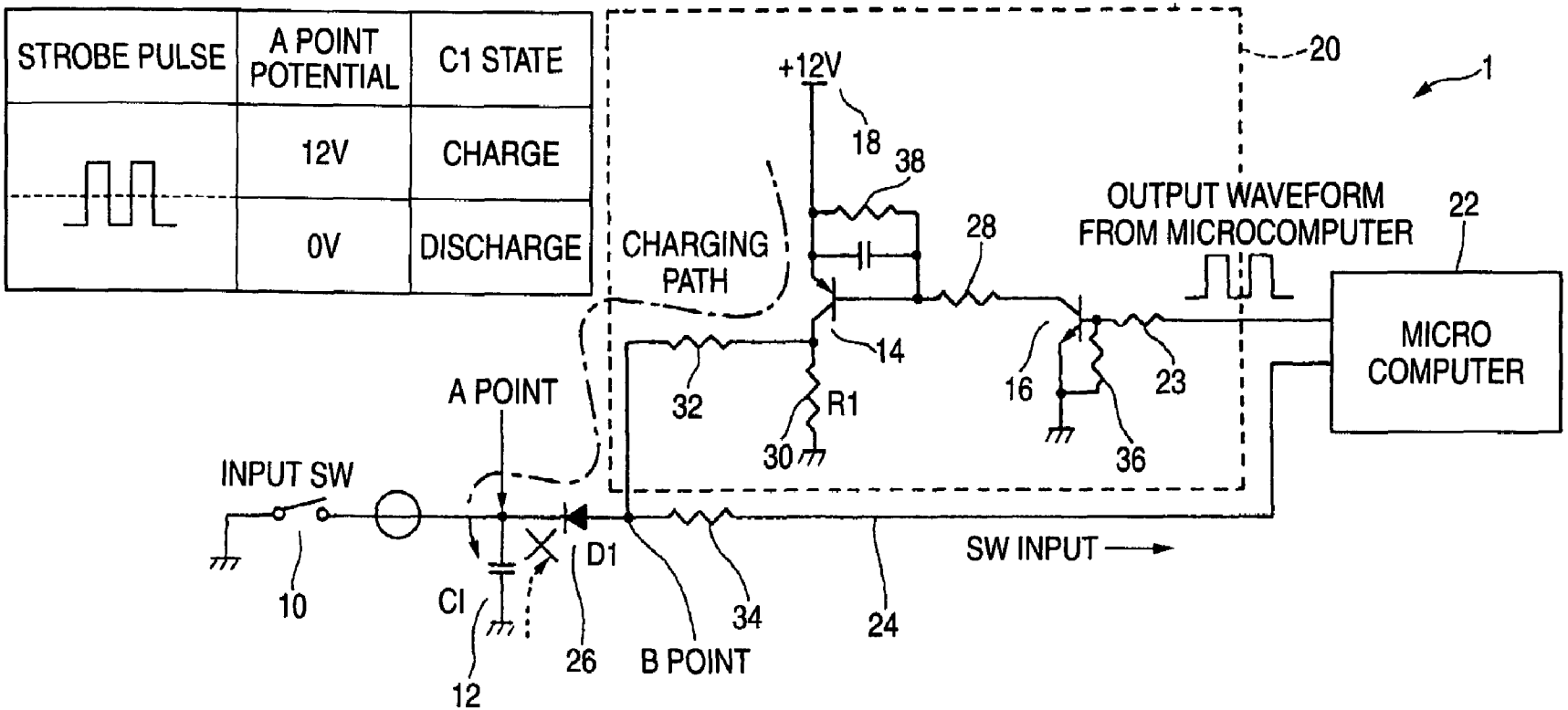
FIG. 1 is a diagram showing an example of the structure of a switch monitoring circuit according to the present invention.

A switch monitoring circuit according to an embodiment of the invention will be described below with reference to FIG. 1. FIG. 1 is a diagram showing an example of the structure of the switch monitoring circuit according to the present invention.

As shown in FIG. 1, a switch monitoring circuit 1 according to the embodiment is connected to a switch 10 for giving a command to open and close a door mirror, for example, in response to the operation of an operator. The switch monitoring circuit 1 includes a capacitor 12, a voltage applying unit 20 constituted by a PNP unit transistor 14, an NPN unit transistor 16 and a battery 18, a microcomputer 22, a voltage detecting unit including an input line 24, and a diode 26.

The output terminal of the microcomputer 22 is connected to the base of the transistor 16 through a resistor 23. The transistor 16 has an emitter connected to a ground and a collector connected to the base of the transistor 14 through a resistor 28. The transistor 14 has an emitter connected to the battery 18 and a collector connected to a ground through a pull-down resistor 30. A resistor 32 and a switch are provided in series in parallel with the pull-down resistor 30. Moreover, one of the ends of the input line 24 having a resistor 34 is connected to a portion (B point) between the resistor 32 and a switch 10, and the other end of the input line 24 is connected to the input terminal of the microcomputer 22. A resistor 36 is a resistor for a bias of the transistor 16, and furthermore, a resistor 38 is a resistor for a bias of the transistor 14.

A capacitor 12 is inserted in parallel with the switch 10 between the switch 10 and the B point. Moreover, the diode 26 is provided in series between the capacitor 12 and the B point. The diode 26 is provided with the direction of the flow of an electric charge generated by the supply of a power from the battery 18 set to be a forward direction.

Description will be given to the operation of the switch monitoring circuit 1 having such a structure and the features of the invention. The microcomputer 22 oscillates a strobe pulse, that is, a pulse in which a high level and a low level are repeated in a predetermined cycle (for example, 20 ms) based on a previously input timing. The strobe pulse thus oscillated is applied as a control signal to the base of the transistor 16. The transistor 16 turns ON/OFF the transistor 14 based on the control signal. A voltage of 12V is intermittently applied from the battery 18 toward the switch 10 by the ON/OFF control of the transistor 14. A change in the voltage applied to the switch 10, that is, a voltage drop is monitored, and the ON/OFF state of the switch is decided by the microcomputer based on the change. When detecting that the switch is closed (ON state), the microcomputer serves to give a command to a microcomputer for controlling a motor to drive a door mirror.

In such a switch monitoring circuit 1, when the switch 10 is opened and when the strobe pulse oscillated from the microcomputer 22 is on the high level, a power is supplied from the battery 18 to an A point between the switch 10 and the capacitor 12. Therefore, an electric charge generated by the supply of the power is stored in the capacitor 12. On the other hand, when the strobe pulse oscillated from the microcomputer 22 is on the low level, the supply of the power from the battery 18 is stopped.

In the case that the supply of the power from the battery 18 is stopped, the electric charge stored in the capacitor 12 tries to be emitted toward the ground point connected to the pull-down resistor 30 or the input line 24 of the microcomputer. If the electric charge stored in the capacitor 12 is emitted, the charging and the discharging are repeated by the capacitor 12 every cycle of the strobe pulse. As a result, a dark current to be generated on the vehicle in the sleep state is increased. Consequently, the battery 18 is dead so that the vehicle cannot be driven in some cases.

In the switch monitoring circuit 1 according to the embodiment, therefore, the diode 26 is provided between the capacitor 12 and the B point. When the switch 10 is opened, consequently, the emission of the electric charge stored in the capacitor 12 can be prevented by the rectifying function of the diode 26 even if the electric charge generated by the supply of the power from the battery 18 is stored in the capacitor 12 and the supply of the power is then stopped. Accordingly, the charging and the discharging can be prevented from being repeated by the capacitor 12. Therefore, it is possible to reduce the consumed current of the capacitor 12. As a result, it is possible to reduce the dark current to be generated on the vehicle in the sleep state.

Furthermore, the dark current is reduced. Consequently, it is possible to prevent the battery from being dead due to the vehicle having a formation into a module.

While the invention has been described above based on the embodiment, the switch monitoring circuit according to the invention is not limited thereto. For instance, while the description has been given to the example in which the diode 26 is provided between the capacitor 12 and the B point, a first diode can be provided between the B point and the pull-down resistor 30 and a second diode can be provided between the B point and the microcomputer 22. In brief, it is preferable that the voltage applying unit 20 and the microcomputer 22 should be connected to the switch 10 and the capacitor 12 through the diode.

While the switch monitoring circuit for monitoring the switch of a door mirror has been described in the embodiment, moreover, this is not limited. For example, if the switch is used for devices to be turned ON in a sleep state, for example, a door lock and an interior light, the switch monitoring circuit according to the invention can be applied.

While the switching portion for carrying out an ON/OFF control is constituted by the transistor 14 and the transistor 16 in the embodiment, furthermore, this is not limited but it is possible to use a control circuit capable of carrying out the ON/OFF control.

What is claimed is:

1. A switch monitoring circuit, comprising:

a switch arranged to be turned ON/OFF in response to an operation;

a capacitor connected to both ends of the switch;

a voltage applying unit that applies a voltage to the switch in response to a command;

a voltage detecting unit that detects the voltage applied to the switch; and a diode connected to the switch and the capacitor, wherein the diode prevents an electric charge stored in the capacitor from being emitted; and wherein the voltage applying unit comprises a transistor circuit including a pull-down resistor, and the diode prevents the electric charge stored in the capacitor from being emitted through the pull-down resistor.

2. The switch monitoring circuit as set forth in claim 1, wherein the voltage applying unit is connected to the switch and the capacitor through the diode.

3. The switch monitoring circuit of claim 1, wherein the voltage applying unit comprises a transistor that is turned on and off in response to an intermittent signal to switch the voltage applied to the switch.

4. The switch monitoring circuit of claim 3, wherein the transistor is a bipolar junction transistor.

* * * * *